US005924832A

United States Patent [19]

Rice

[11] Patent Number: 5,924,832

[45] Date of Patent: Jul. 20, 1999

[54] HOISTING APPARATUS FOR A TENT POLE

[76] Inventor: Maury Rice, 5348 Shirley Ave., Tarzana, Calif. 91356

[21] Appl. No.: 08/948,961

[22] Filed: Oct. 10, 1997

[51] Int. Cl.[6] ..... A01G 23/02

[52] U.S. Cl. ..... 414/23; 280/652; 280/47.131; 135/908

[58] Field of Search ..... 414/23; 135/905, 135/912, 98, 99, 114, 88.06, 908; 280/47.131, 47.17, 47.23, 47.27, 63, 79.2, 652

[56] References Cited

U.S. PATENT DOCUMENTS

| | | | |
|---|---|---|---|
| 3,112,037 | 11/1963 | Thiermann | 414/23 |
| 3,301,570 | 1/1967 | Berman | 280/47.131 |
| 3,873,119 | 3/1975 | Koch | 280/47.131 |
| 4,362,451 | 12/1982 | Thiermann, Sr. | 414/23 |
| 4,753,445 | 6/1988 | Ferrare | 280/47.131 |
| 5,035,437 | 7/1991 | Woodward | 280/652 X |
| 5,131,670 | 7/1992 | Clements et al. | 280/652 X |
| 5,248,157 | 9/1993 | Rice | 280/47.131 |
| 5,803,471 | 9/1998 | DeMars et al. | 280/652 X |

*Primary Examiner*—Johnny D. Cherry
*Assistant Examiner*—Steven B. McAllister
*Attorney, Agent, or Firm*—George J. Netter

[57] ABSTRACT

A hoisting apparatus (10) for a tent pole (16) includes a skid plate assembly (12) separably joined to a wheeled bracket (14). In use, a lower end of the pole (16) is received within a pipe section (20) and the upper pole end engages the tent. The wheeled bracket is pulled along the ground by a cable (58) until the tent is raised at which time pins (50,52) are removed separating the wheeled bracket (24) from the plate assembly (12) for storage.

5 Claims, 2 Drawing Sheets

HOISTING APPARATUS FOR A TENT POLE

BACKGROUND

1. Field of the Invention

The present invention relates generally to apparatus for use in hoisting or raising poles which support a tent, and, more particularly, to such apparatus for moving the lower end of a tent pole so as to place the tent pole in a substantially vertical position on raising the tent.

2. Description of Related Art

It is necessary in erecting large tents (e.g., circus tents) to position one or more supporting tent poles in a vertical relationship, the upper end of the poles being secured in a suitable manner to the tent wall material and a lower end of each pole being positioned on the ground. A generally employed technique at the present time for erecting such poles is to place a skid member under the pole and manually move the pole with tent material carried on the upper end of the pole to the desired location, all of which requires levering of tent sides and ceiling to the raised position.

U.S. Pat. No. 5,248,157, TENT POLE HOISTING APPARATUS, by Maury Rice, assigned to the same assignee as the subject patent application, discloses a unitary arrangement of a skid plate with an end retainer within which the lower end of a tent pole is positioned and a pair of wheels are permanently mounted to the skid plate. In use, after the pole has its lower end received in the retainer a cable attached to the entire assembly is then pulled substantially horizontally of the ground and rolling the retainer to a position elevating the tent pole vertically. The wheel assembly remains secured to the end of the pole throughout use of the tent and exposed to the view of those entering and using the tent. The continued presence of the wheels and associated apparatus mounted to the skid plate not only destroys aesthetics but also takes up space and can be tripped over or at least obstructs normal passage of equipment and individuals within the tent.

SUMMARY OF THE INVENTION

The raising of a large tent such as a circus tent consists generally of spreading the tent material generally flat on the ground then locating one or more tent poles underneath the tent material and affixing what is to be the upper end of each pole to an appropriate levering point on the tent material. The apparatus of the present invention includes a relatively flat base plate having an upstanding section of an open-ended pipe secured to the plate by welding, for example. The internal diameter of the pipe section is sufficient to receive the end of a tent pole therein for support. First and second journals are received on the base plate and secured thereto at opposite sides of the pipe section. A wheeled bracket assembly includes a pair of generally parallel opposite side walls with openings therethrough which are of such geometry and dimensions as to permit an alignment relation with the two journal assemblies on the base plate. A pair of clevis pins are passed through the openings in the bracket side walls and extend through the journals providing releasable securement into a unitary relation of the wheeled bracket and skid plate.

In use, the entire apparatus is located on the lower end of a tent pole and a pole cable interconnected with an eye-bolt that is part of the assembly is moved horizontal to the ground to pull the lower end of the pole to a position vertically below the upper end of the pole thereby raising the pole and tent as desired. When the proper vertical orientation of the pole is achieved, the base plate is staked in place in conventional manner and the clevis pins are removed so that the wheeled bracket can be dismantled from the skid plate and conveniently stored.

DESCRIPTION OF THE DRAWING

The description of a preferred embodiment of the invention given herein can be more fully understood by reference to the accompanying drawing, in which.

DESCRIPTION OF A PREFERRED EMBODIMENT

Figure 1:
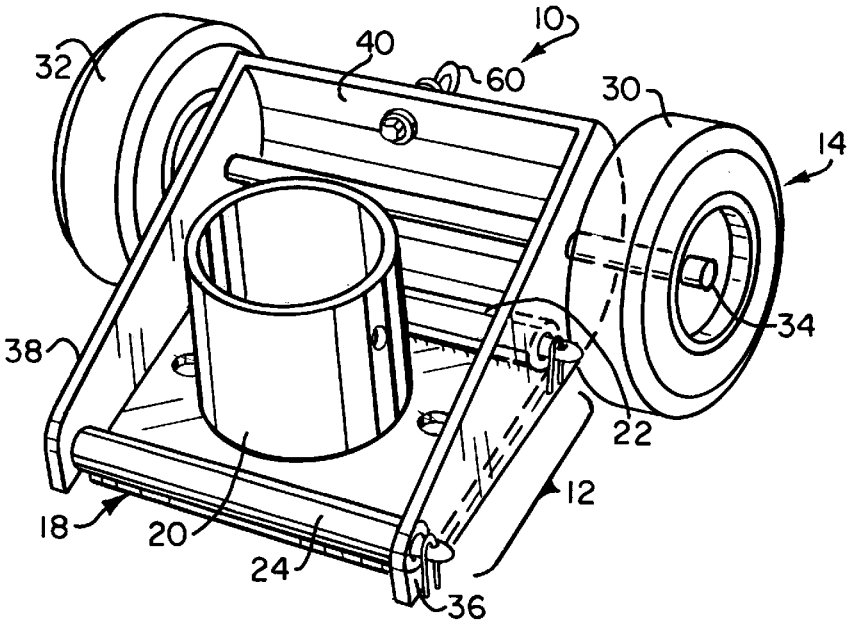
FIG. 1 is a perspective view of the skid plate apparatus of the present invention.
Figure 2:
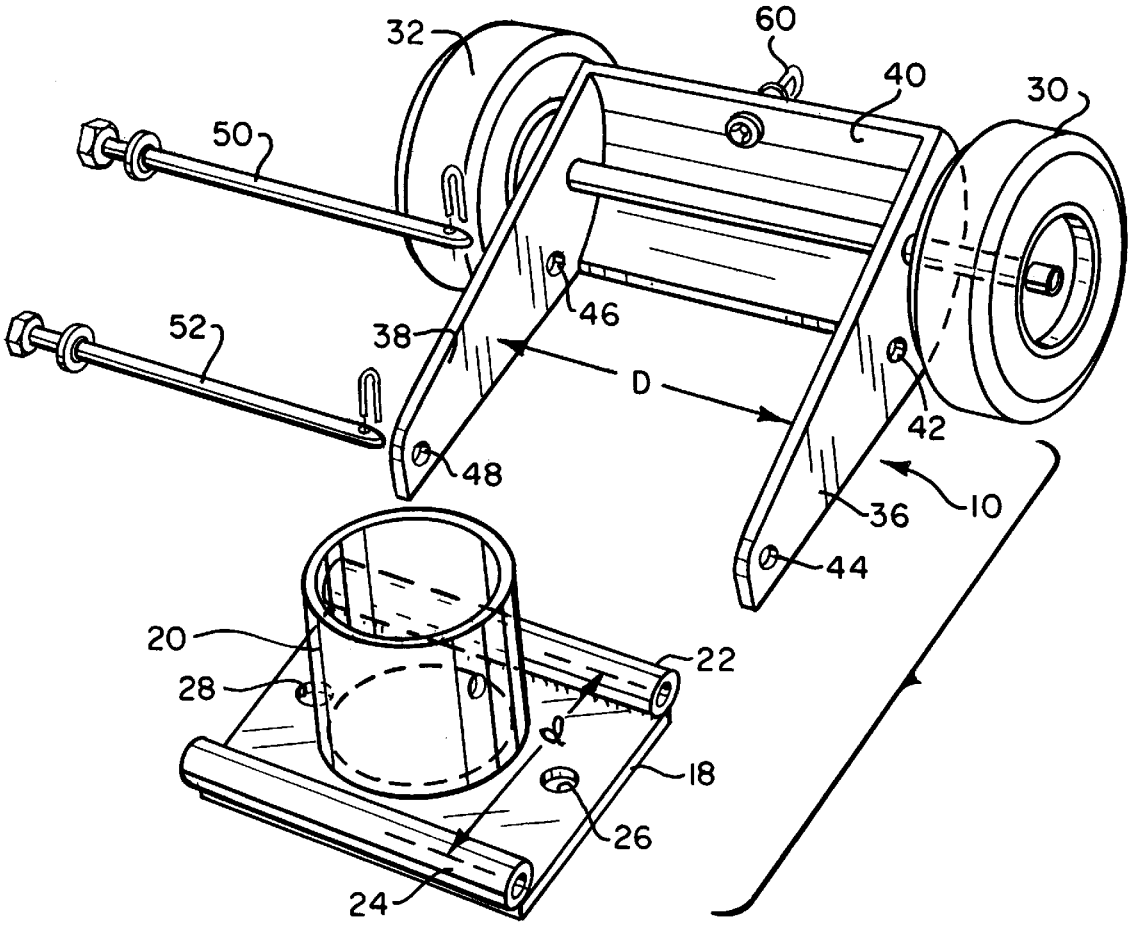
FIG. 2 is an exploded view of the various parts of the invention.

For the ensuing detailed description of the invention, reference is now made to the drawing and particularly FIGS. 1 and 2 where the invention in its entirety is enumerated as 10. As shown, the invention includes a plate assembly 12 and a wheeled bracket 14 which are releasably joinable together to provide the apparatus 10. In general use, the invention is assembled onto the end of a tent pole 16 and utilized in a way that will be described to raise the tent pole to appropriate vertical position then the wheeled bracket is removed. The skid plate assembly 12 includes a generally rectangular metal plate 18 serving as the base for the assembly and a centrally located upstanding pipe section 20 which is secured to the base 18 by welding, for example. The internal diameter of the pipe section 20 is sufficient to enable the lower end of the tent pole 16 to be slidingly received therein.

First and second elongated, tubular journals 22 and 24 are secured to a common upper side of the plate 18 along opposite edges and substantially parallel to one another. A pair of openings 26 and 28 are formed in the base plate at opposite sides of the pipe section 18 for receiving stakes therethrough to be driven into the ground for stabilization purposes after the tent pole and tent have been raised.

The wheeled bracket 14 includes first and second wheels 30 and 32 located on the ends of an axle 34 which extends through parts of the bracket to be described. More particularly, first and second side walls 36 and 38 are joined together in spaced apart relation at one end by a curved back wall 40. The axle 34 extends through appropriate openings in both of the side walls 36 and 38 with the wheels conventionally and rotatably located on the outer ends of the axle. The side walls are held spaced apart transversely a distance D by the curved back wall 40 which is sufficient to enable sliding receipt of the two side walls along the opposite ends of the journals and plate 18 as shown in FIG. 1. A pair of spaced apart openings 42 and 44 in the side wall 36 are aligned with similar openings 46 and 48 in the further side wall 38. Openings 42,44 and 46, 48 are spaced apart an identical distance which equals the spacing d of the tubular journals 22 and 24.

On assembly of the wheeled bracket 14 to the base plate 12, the two side walls 36 and 38 are located immediately opposite the ends of the tubular journals 22 and 24 and unitary securement is effected by pressing elongated pins 50 and 52 through the openings in the side walls and along the journals 22 and 24 each of which pins have an enlarged head at one end and a clevis at the opposite end. It is important to note that when the fully assembled apparatus 10 has its plate 18 resting on a smooth flat ground plane that the lower surface of the wheels 30 and 32 are held spaced slightly from the ground plane. Also, the curved back wall 40 presents a convex curve facing the ground plane to aid in both sliding and rolling movement during use.

Figure 3:
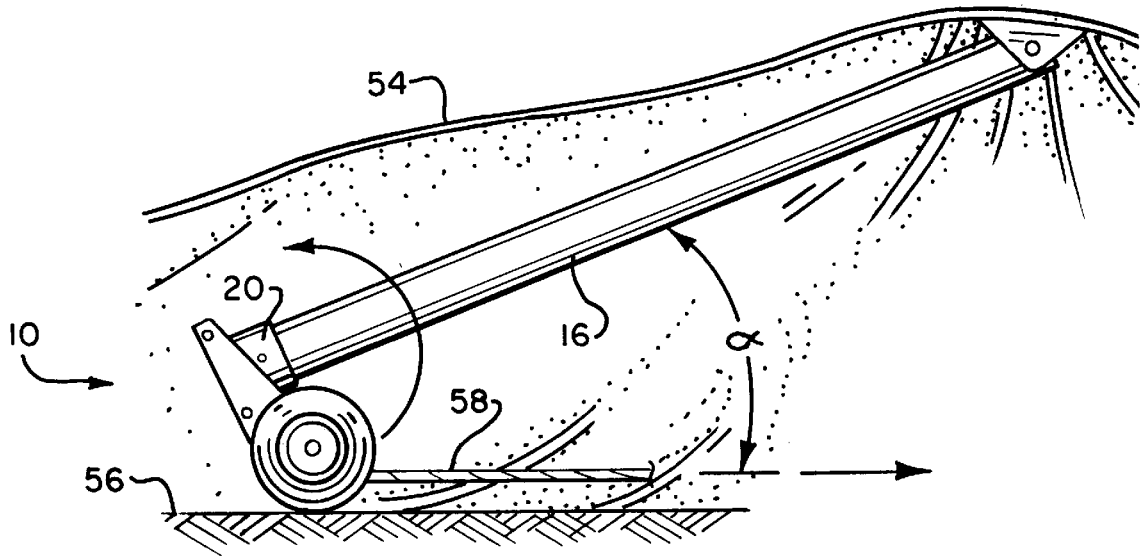
FIGS. 3 and 4 are elevational views showing a tent pole in both initial substantially horizontal condition and in final upright raised position, respectively.
Figure 4:
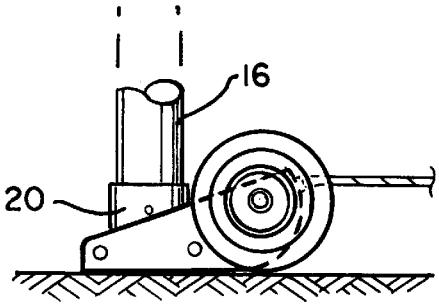

To raise a tent using the invention, the tent material 54 is stretched out on the ground 56 and a generally horizontal tent pole 16 upper end is attached to a conventional levering point from underneath the material and the lower end of the pole is received in pipe section 20 of apparatus 10 (FIG. 3). Then, a pulling force is applied in the direction of the arrow by a cable 58 connected to an eyelet 60 on the wheeled bracket until the pole is vertical as in FIG. 4. Then the plate 18 is staked to the ground and pins 50 and 52 are removed releasing the wheeled bracket 14 for convenient storage.

Although the invention has been described in connection with a preferred embodiment, it is to be understood that those skilled in the appertaining arts may make modifications that come within the spirit of the invention and ambit of the appended claims.

What is claimed is:

1. Apparatus for hoisting a tent pole and tent material above a generally horizontal surface, comprising:

a base plate including first and second parallel spaced-apart tubular journals secured to a common major surface of said plate;

a pipe section having an end secured to the base plate common major surface and an opposite end extending away from said common major surface for receiving an end portion of a tent pole therein;

a bracket having a pair of spaced-apart sidewalls located on respectively opposite sides of the base plate and a transverse wall unitarily securing the sidewalls to each other, said sidewalls each having a pair of openings so spaced as to align with the tubular journals;

a pair of wheels on an axle which is rotatably mounted to the bracket; and first and second pins received within the respective sidewall openings and tubular journals for releasably securing the bracket and base plate in unitary relation.

2. Apparatus as in claim 1, in which the transverse wall is convexly curved in a direction facing the ground surface.

3. Apparatus as in claim 1, in which the tubular journals are welded to the base plate.

4. Apparatus for hoisting a tent pole while supporting an extent of tent material, comprising:

a flat rectangular metal base plate;

first and second hollow tubular journals welded to a major surface of the base plate adjacent respective opposite edges of the base plate with longitudinal axes of said journals being generally parallel to one another;

a hollow pipe section having an end surface welded in a generally central part of the major surface of the base plate and extending at 90-degrees to said surface, said pipe section having a bore of cross-sectional dimensions enabling sliding receipt of an end portion of the tent pole therein;

a bracket having a pair of identically shaped sidewalls held spaced-apart and unitary by a transverse wall an amount slightly larger than one of the base plate edges along which a tubular journal extends, each sidewall having a pair of openings spaced apart the same amount as the distance between the parallel tubular journals and said sidewall openings being relatively arranged so that the sidewalls can be located to align the tubular journal bores with respective sidewall openings;

a pair of wheels being rotatably mounted to the bracket; and first and second means extending through the respective sidewall openings and aligned tubular journals for releasably securing the bracket and base plate together.

5. Apparatus as in claim 4, in which said means each includes an elongated pin with an enlarged head at one end and a clevis at an opposite end preventing inadvertent withdrawal of the pin from the sidewall openings and journals.

* * * * *